US006563931B1

(12) United States Patent
Soli et al.

(10) Patent No.: US 6,563,931 B1
(45) Date of Patent: May 13, 2003

(54) AUDITORY PROSTHESIS FOR ADAPTIVELY FILTERING SELECTED AUDITORY COMPONENT BY USER ACTIVATION AND METHOD FOR DOING SAME

(75) Inventors: Sigfrid D. Soli, Sierra Madre, CA (US); Ralph P. Fravel, Woodbury, MN (US)

(73) Assignee: K/S HIMPP, Vaerloese (DK)

( * ) Notice: Subject to any disclaimer, the term of this patent is extended or adjusted under 35 U.S.C. 154(b) by 0 days.

(21) Appl. No.: 07/921,508

(22) Filed: Jul. 29, 1992

(51) Int. Cl.[7] ..... H04R 25/00
(52) U.S. Cl. ..... 381/318; 381/321; 381/83
(58) Field of Search ..... 381/68, 68.2, 68.4, 381/71, 93, 72, 83, 312, 318, 320, 321

(56) References Cited

U.S. PATENT DOCUMENTS

| | | | | |
|---|---|---|---|---|
| 4,025,721 A | | 5/1977 | Graupe et al. | |
| 4,185,168 A | | 1/1980 | Graupe et al. | |
| 4,425,481 A | * | 1/1984 | Mansgold et al. | 381/68 |
| 4,471,171 A | | 9/1984 | Kopke et al. | |
| 4,630,304 A | | 12/1986 | Borth et al. | |
| 4,658,426 A | * | 4/1987 | Chabris et al. | 381/93 |
| 4,759,071 A | | 7/1988 | Heide | |
| 4,783,818 A | * | 11/1988 | Graupe et al. | 381/71 |
| 4,791,390 A | * | 12/1988 | Harris et al. | |
| 4,815,140 A | | 3/1989 | Wagner | |
| 4,815,141 A | | 3/1989 | Carver et al. | |
| 4,956,867 A | | 9/1990 | Zurek et al. | 381/94.1 |
| 5,027,410 A | | 6/1991 | Williamson et al. | |
| 5,083,312 A | | 1/1992 | Newton et al. | 381/68.4 |
| 5,091,952 A | | 2/1992 | Williamson et al. | |
| 5,259,033 A | * | 11/1993 | Goodings et al. | 381/68 |

OTHER PUBLICATIONS

Widrow et al., Adaptive Signal Processing, 1985, pp. 103–106 & 305.*

* cited by examiner

*Primary Examiner*—Huyen Le
(74) *Attorney, Agent, or Firm*—Sughrue Mion, PLLC

(57) ABSTRACT

An auditory prosthesis, and method, which is able to adapt better to filter out a selected unwanted portion of the auditory input signal by relying on a human activation, such as activation by the user, who knows by listening when the auditory environment contains only, or mostly only, the selected unwanted portion of the auditory input signal. This person may then activate the adaptive filter of the auditory prosthesis. The adaptive filter then utilizes the then current auditory environment as a noise reference on which to adapt. A transducer is adapted to receive the environmental sound and convert the environmental sound into an electrical input signal. The electrical input signal contains a selected electrical component corresponding to the selected auditory component in the environmental sound. An adaptive filter receives the electrical input signal and provides a filtered signal. The adaptive filter has adaptable filtering characteristics based upon a reference. The adaptive filter is operable in response to activation by the user to adapt the filtering characteristics using the electrical input signal as the reference to determine the filtering characteristics required to filter the selected electrical component from the electrical input signal. The filtered signal is received and converted to the auditory stimulus.

15 Claims, 3 Drawing Sheets

AUDITORY PROSTHESIS FOR ADAPTIVELY FILTERING SELECTED AUDITORY COMPONENT BY USER ACTIVATION AND METHOD FOR DOING SAME

TECHNICAL FIELD

The present invention relates to auditory prostheses and, more particularly, to auditory prostheses for adaptively filtering a selected auditory component from an auditory input signal, and methods for doing the same.

BACKGROUND OF THE INVENTION

Auditory prostheses, particularly hearing aids, are utilized by persons having impaired hearing or by persons who want to improve their hearing acuity. While such auditory prostheses are often extremely beneficial in quiet environments, they are usually of more limited benefit in environments which are noisy.

Environmental noise is often tolerated by persons with unimpaired hearing with no more discomfort than annoyance at the existence of such noise and the reduced ability to understand speech in the presence of such noise. However, for persons with impaired hearing fitted with an auditory prostheses or a hearing aid having a fixed frequency response, environmental noise is often disturbing, often interferes with their ability to understand speech, and is sometimes physically painful.

Environmental noise can be classified as follows:

(1) relatively short duration noise such as the clicking of shoes during walking or of dishes during stacking, i.e., so-called "punctate noise";

(2) relatively long duration noises having near-stationary spectral characteristics such as the noise associated with passing cars, trains and airplanes or running fans or machinery, i.e., so-called "constant background noise"; and (3) relatively long duration noises that lack stationary spectral characteristics such as a background conversation.

The latter class of noise noted above may partially mask speech preventing its being understood by a hearing aid user and is disturbing for this reason. However, this type of noise generally does not assault the impaired user's ear as much as do the "punctate noise" and "constant background noise".

A relatively satisfactory solution to the problem of punctate noises is obtained by incorporating automatic gain control (AGC) into the circuitry of the hearing aid. Such circuitry responds to a sudden, high intensity click, by automatically reducing the volume for the duration of the click. This reduces not only the intensity of the sound of the click, but also reduces the intensity of the sound of any intelligence occurring simultaneously with click. Little loss of intelligibility of speech occurs, however, because of the short duration of the gain reduction and the ability of the ear, in cooperation with the brain, to fill in the relatively short information gap depending on the attack and release times of the AGC circuitry.

In contrast however, constant background noise generally contains much the same frequency spectrum as the desirable speech signal. Therefore, schemes to remove constant background noise must avoid diminishing the intelligibility of the speech signal.

In general, two methods of constant background noise removal have been employed in prior art hearing aid devices.

In one technique used in some auditory prostheses, or hearing aids, a single microphone is used to receive both wanted and unwanted parts of the auditory signal and the total auditory signal is processed to de-emphasize the unwanted part, i.e., the noise, relative to the wanted part, i.e., the speech. For example, a good deal of unwanted noise usually exists in the low frequency bands of speech and can actually mask some of the desired high frequency parts of speech. (This is called the upward spread of masking.) By de-emphasizing the lower frequency parts of the signal, i.e ., attenuating the frequencies between 50 and 500 Hertz, for example, the unwanted noise signal is decreased (along with some of the wanted speech signal) making the higher frequency parts of the speech discernible. The overall effect can be to increase the intelligibility of speech in the presence of noise.

One variation of the single microphone technique is to provide a directionality to the microphone so that the wearer (user) can optimize the wanted part of the signal, the speech, while decreasing any unwanted part of the signal, the noise, which is not directionally coincident with the speech signal.

In either case, however, these techniques suffer from the fact that both the wanted and unwanted parts of the auditory signal are picked received by the single microphone. Since there is very little spectral difference between the signals, the ability to separate them is limited.

Another technique for auditory prostheses, or hearing aids, uses two microphones. One microphone is used to receive the total auditory signal (including the wanted speech and unwanted noise parts of the auditory signal). A second microphone is used to receive the unwanted noise part of the auditory signal. The unwanted noise signal from the second microphone is then "subtracted" from the total auditory signal from the first microphone to provide "noise-free" sound. This technique depends on positioning the second microphone so that it receives only the unwanted part of the auditory signal, i.e., the noise, for optimum operation. This generally is not possible in a hearing aid because both microphones have to be carried on the user, making it very difficult to position the second microphone so that it picks up only the unwanted part of the auditory signal. Thus, the second microphone usually picks up some of the wanted speech signal as well as unwanted noise signal. This results in some cancellation of the wanted speech signal as well as the unwanted noise signal.

Yet another background noise filtering technique is illustrated in the system disclosed in U.S. Pat. No. 4,025,721, Graupe et al, Method of and Means For Adaptively Filtering Near-Stationary Noise From Speech. The Graupe et al '721 patent discloses a single microphone hearing aid system having a noise filter between the microphone and the amplifier section of the hearing aid. The filter is designed to filter out the constant background noise present in the user's environment. The filter includes means for continuously adjusting itself in response to the prevailing noise conditions. The system disclosed in the Graupe et al '721 patent includes circuitry which attempts to identify pauses in speech when, presumably, only unwanted noise is present at the microphone. When the system detects what it believes to be a pause, it activates the filter to cause it to adapt its noise filtering characteristics to filter out the sounds present at the microphone at that time. During intervals when the system detects the presence of speech, the characteristics of the filter remain fixed at the last setting. The system disclosed in the Graupe et al '721 patent, thus, attempts to avoid cancellation of the speech component of the input signal to the hearing aid by changing its filtering characteristics only when it believes no speech is present in the environment.

One problem with the system disclosed in the Graupe et al '721 patent is that the repeated adaption of the filter during what the system detects as pauses in speech creates a "pumping" sound audible by the user of the hearing aid. This pumping sound is believed to result from the relatively abrupt, i.e., rapid, reconfiguration of the frequency response of the hearing aid as the characteristics of the noise filter are changed. To the hearing aid user these abrupt and repeated adjustments make it seem as though the gain of the hearing aid is being continuously turned up and down, i.e., continuously changing the quality of the sound heard by the user. This "pumping" can be annoying and the system may not be accepted by some users.

Another problem with the system disclosed in the Graupe et al '721 patent is that it assumes that the sound occurring during pauses in speech constitutes unwanted noise. While this is true where the signal of interest is speech, there are other circumstances in which the signal of interest is of a different character. For example, if the hearing aid user were an automobile mechanic, the signal of interest might be the sound generated from a running engine. For another example, the hearing aid user may wish to hear the sounds of a rushing waterfall. In the case of either of these examples, the system disclosed in the Graupe et al '721 patent would tend to adjust itself to filter out the sounds desired to be heard by the user. Accordingly, it deprives the user of access to sounds other than speech. Moreover, the background noise sought to be eliminated can be speech itself in the form of crowd noise at a party, meeting or some other public gathering. The system disclosed in the Graupe et al '721 patent would obviously have difficulty in such situations in identifying the wanted speech of interest and the unwanted "noisy" speech sought to be filtered out.

Another disadvantage of the system disclosed in the Graupe et al '721 patent is the circuitry "overhead" required to identify pauses in speech. This problem compounded by the difficulty of designing simple detection circuitry which can accurately identify the presence and absence of speech in the user's environment. This overhead increases the cost of producing the hearing aid and hampers miniaturization efforts.

SUMMARY OF THE INVENTION

The present invention provides an auditory prosthesis, and method, which is able to adapt better to filter out a selected unwanted portion of the auditory input signal even when only a single microphone is used. The present invention relies on a human activation, such as activation by the user, who knows by listening when the auditory environment contains only, or mostly only, the selected unwanted portion of the auditory input signal. This person may then activate the adaptive filter of the auditory prosthesis. The adaptive filter then utilizes the then current auditory environment as a noise reference on which to adapt. The result is that the auditory prosthes is adapts to cancel the auditory environment selected by the activator so that the unwanted portion of the auditory environment is de-emphasized. The user of the auditory prosthesis then enjoys a sound environment relatively free from the noise reference signal.

The present invention provides an auditory prosthesis which is adapted to receive environmental sound containing a selected auditory component. The auditory prothesis is adapted to supply an auditory stimulus which is perceptible to a user. A transducer is adapted to receive the environmental sound and convert the environmental sound into an electrical input signal. The electrical input signal contains a selected electrical component corresponding to the selected auditory component in the environmental sound. An adaptive filter receives the electrical input signal and provides a filtered signal. The adaptive filter has adaptable filtering characteristics based upon a reference. The adaptive filter is operable in response to activation by the user to adapt the filtering characteristics using the electrical input signal as the reference to determine the filtering characteristics required to filter the selected electrical component from the electrical input signal. The filtered signal is converted to an auditory stimulus by a receiver (output transducer).

In an embodiment, the adaptive filter, in response to the activation by the user, is operable to adapt the filtering characteristics rapidly.

In another embodiment, the adaptive filter operates, when not rapidly adapting, to continuously slowly adapt the filtering characteristics using the electrical input signal as the reference to determine the filtering characteristics required to filter the selected electrical component from the electrical input signal.

In another embodiment, the filtering characteristics are fixed after the rapid adaption is complete and until the user reactivates the adaptive filter.

In another embodiment, the auditory prosthesis has a manually activated switch electrically connected to the adaptive filter to provide for activation of the adaptive filter by the user.

In another embodiment, the adaptive filter continues to rapidly adapt once activated by the user and is responsive to deactivation by the user to terminate the rapid adaption.

In another embodiment, the adaptive filter terminates from rapidly adapting automatically based upon predetermined termination criteria.

The present invention also provides an auditory prosthesis adapted to receive environmental sound which contains a selected auditory component predominantly at certain times and which contains both the selected auditory component and unselected components at other times. The auditory prothesis is adapted to supply an auditory stimulus perceptible to a user. A transducer is adapted to receive the environmental sound and convert the environmental sound into an electrical input signal. The electrical input signal contains a selected electrical component corresponding to the selected auditory component in the environmental sound. An adaptive filter receives the electrical input signal and provides a filtered signal. The adaptive filter has adaptable filtering characteristics based upon a reference and is operable in response to activation by the user, when the environmental sound predominantly contains only the selected auditory component, to adapt the filtering characteristics using the electrical input signal as the reference so that the adaptive filter substantially filters the selected electrical component from the electrical input signal. A receiver receives the filtered signal and converts the filtered signal to the auditory stimulus. Thus, the auditory prosthesis is able to adapt upon activation by the user to provide the auditory stimulus which substantially removes any component corresponding to the selected auditory component.

The present invention also provides an auditory prosthesis which is adapted to receive environmental sound which contains a selected auditory component and which is adapted to supply an auditory stimulus perceptible to a user. A transducer receives the environmental sound and converts the environmental sound into an electrical input signal. The electrical input signal contains a selected electrical component corresponding to the selected auditory component in the environmental sound. An adaptive filter receives the electrical input signal and provides a filtered signal. The adaptive filter has adaptable filtering characteristics based upon a reference and is operable in response to an activation signal to rapidly adapt the filtering characteristics using the electrical input signal as the reference to determine the filtering characteristics required to filter the selected electrical component from the input signal. The adaptive filter is operable, when not rapidly adapting, to slowly adapt the filtering characteristics using the electrical input signal as the reference to determine the filtering characteristics required to filter the selected electrical component from the electrical input signal. A receiver receives the filtered signal and converts the filtered signal to the auditory stimulus.

In one embodiment, the adaptive filter adapts approximately thirty-two times faster when rapidly adapting than when slowly adapting.

The present invention also provides an auditory prosthesis which is adapted to receive environmental sound which contains a selected auditory component predominantly at certain times and which contains both the selected auditory component and unselected components at other times. The auditory prothesis is adapted to supply an auditory stimulus perceptible to a user. A transducer receives the environmental sound and converts the environmental sound into an electrical input signal containing a selected electrical component corresponding to the selected auditory component in the environmental sound. An adaptive filter receives the electrical input signal and provides a filtered signal. The adaptive filter has adaptable filtering characteristics based upon a reference and is operable in response to activation by the user, when the environmental sound predominantly contains only the selected auditory component, to rapidly adapt the filtering characteristics using the electrical input signal as the reference so that the adaptive filter substantially filters the selected electrical component from the electrical input signal. The adaptive filter further is operable, when not rapidly adapting, to slowly adapt the filtering characteristics using the electrical input signal as the reference. A receiver receives the filtered signal and converts the filtered signal to the auditory stimulus. Thus, the auditory prosthesis is able to rapidly adapt in response to activation by the user to provide the auditory stimulus which substantially removes any component corresponding to the selected auditory component.

In one embodiment, the adaptive filter is subject to activation by a human, rather than necessarily the user.

The present invention also provides a method of controlling an auditory prosthesis which is adapted to receive environmental sound which contains a selected auditory component and adapted to supply an auditory stimulus perceptible to a user. The auditory prosthesis has a transducer receiving the environmental sounds and converting the environmental sound into an electrical input signal. The electrical input signal contains a selected electrical component corresponding to the selected auditory component in the environmental sound. An adaptive filter has adaptable filtering characteristics based upon a reference. The filter is operable to filter the electrical input signal to provide a filtered signal. A receiver receives the filtered signal and converts the filtered signal to the auditory stimulus. The method involves placing the auditory prosthesis in use in conjunction with the user with the environmental sound containing the selected auditory component and activating the adaptive filter in response to the user to adapt the filtering characteristics using the electrical input signal as the reference to determine the filtering characteristics required to filter the selected electrical component from the electrical input signal.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
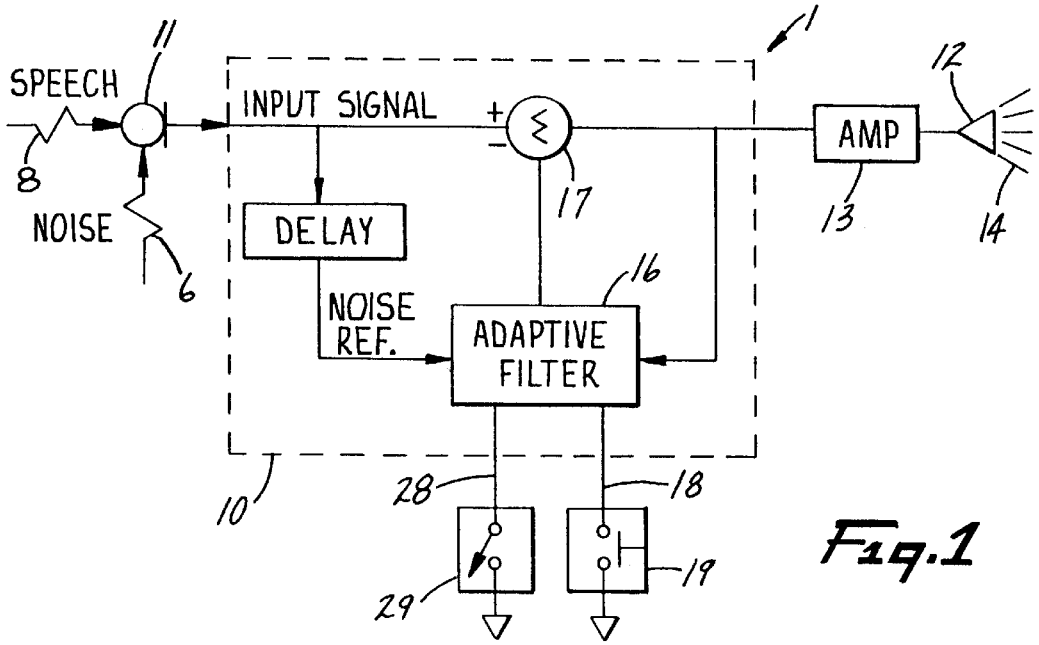
FIG. 1 is a block diagram of an auditory prosthesis having a filtering system according to the present invention.

FIG. 1 illustrates an auditory prosthesis, preferably a hearing aid 1, having an input transducer 11, a filter 10, an amplifier 13 and an output transducer 21 such as a speaker, or in hearing aid parlance, a receiver. Input transducer 11, preferably a microphone, receives auditory sounds from the environment comprising an unwanted component 6, such as noise, and a wanted component 8, such as speech, and supplies its electrical output signal as an input signal to filter 10. Filter 10 filters unwanted component, such as noise, from this input signal and applies the filtered signal to amplifier 13. The output of amplifier 13 is supplied to receiver 21 to provide amplified sound 14 to the ear. Amplifier 13 can be of the design shown in U.S. Pat. No. 4,425,481, Mangold et al, Signal Processor, or in U.S. Pat. No. 4,548,082, Engebretson et al, Hearing Aids, Signal Supplying Apparatus, Systems For Compensating Hearing Deficiencies, and Methods, both of which are hereby incorporated by reference, or any other known design suitable for amplifying an auditory input signal in an auditory prosthesis application. Filter 10 also includes an adaptive filter 16, a summing amplifier 17, and activated control input 18. Filter 10 also preferably includes a delay 15 between the input signal to the filter 10 and adaptive filter 16. Preferably, the control input consists of a manually actuated push-button. Optional components 28 and 29 will be described later with respect to an alternative embodiment of the invention.

Figure 2:
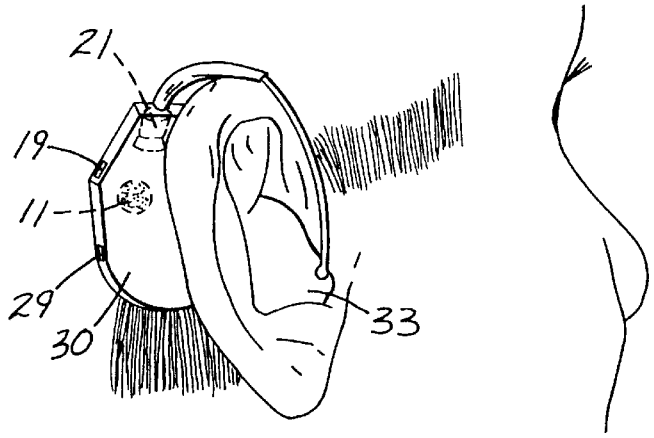
FIG. 2 is a perspective drawing of the auditory prosthesis of FIG. 1 mounted in a housing.

Referring to FIG. 2, auditory prosthesis 1 is shown mounted in a housing 30. As shown, input transducer 11 is mounted in housing 30 so that it can receive auditory sound from the user's or wearer's environment. Preferably, input transducer 11 is of a directional type. Receiver 21 is preferably mounted in housing 30 so that it projects amplified sound into the earpiece 33 fit in the wearer's external ear canal. Preferably, a push button switch 19 provides control input 18 to filter 10 and is mounted to be accessible on the outside of housing 30 so that it may be activated by a human, such as the user of the auditory prosthesis.

Although the auditory prosthesis illustrated in FIG. 2 is a "behind the ear" type of prosthesis, it is recognized and understood that the present invention is utilizable in auditory protheses with other form factors, such as the common "in the ear" and "in the canal" type of auditory prostheses. Again, optional component 29 will be described later with respect to an alternative embodiment of the invention.

As will be discussed in more detail below, the filtering characteristics of filter 10 are rapidly adjusted during a human or user actuated adapting mode to provide for filtering of a selected unwanted component of the ambient auditory signal, such as constant background noise present in the user's environment. According to one embodiment of the invention, the filtering characteristics are then fixed until the adapting mode is again actuated by a human such as the user. The filtering characteristics are fixed in adaptive filter 16, which operates to supply a fixed noise filtering signal to summing amplifier 17 which in turn "subtracts" this noise filtering signal (or reference signal) from the input signal from microphone 11. To the extent that the reference signal matches the constant background noise in the environment, that constant background noise is effectively filtered from the input signal and is not present at the receiver 21 nor discernable by the user in the amplified sound 14.

The user, or other human, can activate the adapting mode of filter 10 by supplying activated control input 18. Activated control input 18 may simply be a push button switch which sends the activated control input 18 signal when the button is, preferably momentarily, pushed. In conjunction with activated control input 18, adaptive filter 16 receives a noise reference signal from delay 15. Adaptive filter 16 then rapidly "adapts" its filtering characteristics to pass a signal which at least somewhat matches the characteristics of the noise reference signal from delay 15.

Optionally, a second microphone may be used to supply the noise reference signal directly to adaptive filter 16. In this case, delay 15 would not be used and the connection between the input signal and the adaptive filter 16 would be removed. The delay 15, although it could still be used, would not be necessary since the second microphone would effectively decorrelate the input signal from the noise reference signal.

Adaptive filter 16 uses these signals to reconfigure its filtering characteristics so as to minimize the error signal (e). Adaptive filter 10 thus reconfigures or adapts to filter out noise present at microphone 11 during the adaption process. The delay introduced by delay 15 decorrelates the noise reference signal from the resulting output of filter 10 from summing amplifier 17 which tends to prevent the filter from adapting to transitory signal inputs such as speech that are not part of the constant background noise sought to be eliminated.

With a single microphone 11 providing the noise reference signal and primary input signal, the adaptive filter 16 will tend to cancel desired signal as well as noise if desired signal is present in the input signal while filter 16 is adapting. The present invention thus allows that a human, such as the user, actuate the adapting mode of the filter 10 when noise alone is present at the microphone, to the best extent possible. For example, the user could wait for a pause in a conversation, or request a pause in a conversation, and actuate the adapting mode during this pause. This allows filter 10 to adapt to characteristics minimizing the noise passing through the filter without causing loss of the desired signal.

The present invention thus permits a human operator, such as the user, to define the unwanted noise sought to be filtered. For example, if the user was desirous of filtering out speech, he would activate the system to reconfigure its filtering characteristics during an interval of time in which speech signals were present in the environment. For another example, if the user sought to hear the noises generated from a running motor, the filtering characteristics would be set in a quiet place out of the presence of the sounds of the running motor.

The present invention contemplates various embodiments of adaptive filter 16. Adaptive filter 16 employs either analog or digital filtering circuits such as minimum variance time domain filter, an augmented Kalman noise filter, or a Wiener filter. Alternatively, the filter can be an adjustable notch filter. Samples of such filters are described in the following references: Sage and Melsa, *Estimation Theory with Applications to Communications and Control,* McGraw Hill (1971); N. Levenson and N. Wiener, *Extrapolation Interpolation and Smoothing of Stationary Time Series,* MIT Press (1964); Y. Z. Tsypkin, *Foundations of the Theory of Learning Systems,* Academic Press, N.Y., N.Y. (1973); M. Schwarz and L. Shaw, *Signal Processing,* McGraw Hill, N.Y., N.Y. (1975); and D. E. Johnson and J. L. Hillburn, *Rapid Practical Design of Active Filters,* John Wiley & Sons, N.Y., N.Y. (1975). Examples of suitable digital filters are found in the publication: D. Grauple, *Time Series Analysis, Identification and Adaptive Filtering,* Krieger Publishing Co., Melba, Fla. (1984), pp. 20–100. The entire disclosures of the above-listed documents are hereby incorporated herein by reference.

There are at least four preferred ways to initiate and control the adaption mode of adaptive filter 16. According to one embodiment, the adaption mode is initiated and terminated by the user by pressing and releasing, respectively, push button switch 18. While held in the adapting mode, adaptive filter 16 continues to adapt in response to the varying conditions of the signal (noise) present at the microphone. Although the characteristics of adaptive filter 16 may very rapidly converge on a steady state condition, these characteristics would be allowed to fluctuate with varying environmental sound until such time that the user terminated the adaption mode by releasing the push button. The advantage of this embodiment is that it permits the hearing aid user to freeze the filtering characteristics of adaptive filter 16 based on what the user hears.

In an alternative embodiment, adaptive filter 16 automatically terminates adaption as soon as the filter characteristics of the filter converge to a desired setting. In contrast to the former approach, the adapting mode would thus be initiated by the user but thereafter the adaption process would be automatically terminated regardless of when the push button switch 18 is released. For this second embodiment, the convergence criterion used to terminate adaption depends on the type of filter used. If LMS (least mean squares) adaption is used in the filter, a convergence criterion can be defined either in terms of the magnitude of the error signal (which should be minimized) or in terms of the average increment in the coefficients as they are adapted (which should approach 0.0). Once either or both of these criteria are reached, adaption would be terminated automatically. With either LMS or an other method of fixed adaption rate, a time-based criterion can be used. Adaption would be ceased automatically and the coefficients would be fixed at their final values after a specified elapsed time, for example one second or less.

Figure 3:
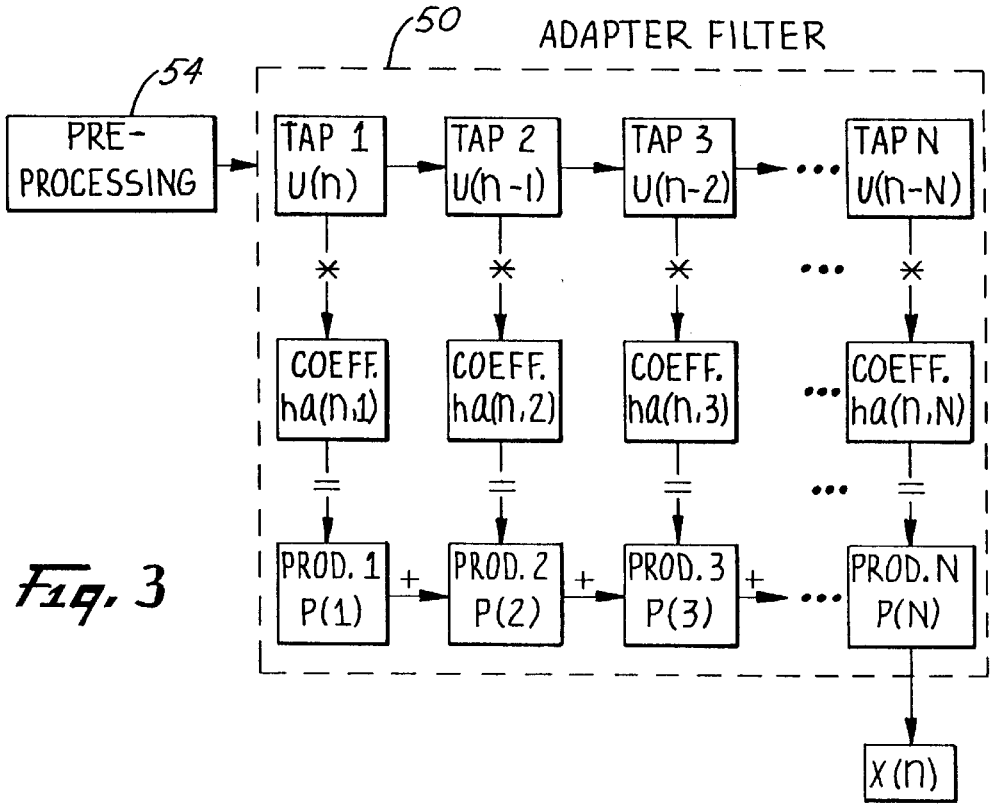
FIG. 3 is a simplified block diagram of an example of an adaptive filter that can be used in the filtering system according to the present invention.

Referring now to FIG. 3, there is shown in more detail an example of an adaptive filter 50 suitable for use as the adaptive filter 16 shown in FIG. 1. Adaptive filter 50 includes a plurality of taps l, 2, 3 . . . N, and a plurality of corresponding tap coefficients 1, 2, 3 . . . N. The adaptive filter 50 receives a data stream of input data d(n), as represented by block 52. A preprocessing circuit 54 (such as delay 15 of FIG. 1) is provided, of a conventional nature, which applies its output to the input of adaptive filter 50. At any given point in time, adaptive filter 50 holds a vector of data U(n) equal to [u(n), u(n-1), u(n-2) . . . u(n-N). This vector of data is maintained in the taps l, 2, 3 . . . N. Adaptive filter 50 further includes a vector of coefficients $H_a(n)$ equal to [ha,n,l), $h_a(n,2)$, $h_a(n,3)$ . . . $h_a(n,N)$, at a given point in time n. Adaptive filter 50 includes means for multiplying the data held in each individual tap by its corresponding coefficient and summing these products to produce, at any given point in time n, an output x(n) equal to $[H_a(n)]t\ U(n)$.

Adaptive filter 50 can be adapted, for example, by updating the $H_a$ coefficient vector to minimize the expected value of the squared difference between $d_{(n)}$ and $x_{(n)}$, i.e., $E\{[e_{(n)}]^{**}2\}$, where $e_{(n)}=d_{(n)}-x_{(n)}$. The updated coefficient vector at time (n+1), $H_a(n+1)$ is computed as $H_a(n-1)=H_a(n)+u\ e(n)\ U(n)$ using least-mean-square (LMS) adaption.

The rate of adaption and convergence can be controlled in several different ways with LMS and sign-sign by varying: (1) the magnitude of u; (2) the frequency of coefficient update; or (3) the number of coefficients modified per update. Using LMS, the coefficient increment, ue(n) U(n), is driven to small values as the filter converges and e(n) is minimized. With sign-sign adaption, however, the coefficient increment, u{sgn[e(n) U(n)]}, depends only on u and does not change as the filter converges.

According to yet another embodiment of the invention, adaptive filter 16 is configured so that it continually operates in a "slow adaption mode". In this mode, it continually adapts at a very slow rate. A slow adaption mode control input 29 (see FIG. 1), preferably a switch, is provided to switch adaptive filter 16 into its continuous slow adaption mode. The slow adaption rate is selected so that changes in the filter characteristics are substantially imperceptible to the hearing aid user, but are fast enough to provide for adaption to gradual changes and background noise. As an example, a preferred rate of change for slow adaption is an order of magnitude slower than rapid adaption. It is preferred that the rate of slow adaption be on the order of 1/32 of the rate of rapid adaption. In one embodiment, the rate time period for slow adaption would be in the range of from one to ten minutes. Accordingly, this embodiment of adaptive filter 16 provides for a first "slow filtering mode" and a second "fast filtering mode" of the type outlined above with respect to the first embodiment of the invention described, as activated by control input 18. As currently contemplated, but without limitation thereto, it is preferred that the fast filtering mode provide adaption at a rate approximately 32 times faster than the rate of adaption in the slow filtering mode. Generally, adaptive filter 16 is preferably designed to adapt itself in approximately one second or less in its fast filtering mode. The rate of adaption in the slow adaption mode is further preferably selected so as to not be so fast as to produce annoying "pumping" sounds.

In its slow filtering mode, adaptive filter 16 will slowly and continuously adapt to any signal present at the microphone. It has been found that in typical situations wherein speech is the desired signal of interest, the unwanted noise sought to be eliminated or reduced is present in the environment for longer intervals than the desired speech signal. Accordingly, the net change in filtering characteristics of the filter hunt towards a setting tending to reduce unwanted noise. It is further contemplated, however, that in certain circumstances wherein the wanted signal is continuously present in the environment that operating adaptive filter 16 in a slow adaption mode would be undesirable, as it would tend to eventually adapt toward eliminating the wanted signal of interest. Thus, this slow adapting/fast adapting embodiment of the invention provides that the user can activate adaptive filter 16 via control input 18 to rapidly adapt to the environmental sounds present at the time activated, and thereafter adaptive filter 16 will remain fixed until the slow adapting/fast adapting mode is again activated.

Preferably, after rapid adaption, the adaptive filter 16 would then return to its slow adapting mode to track gradual changes in noise conditions.

Thus, the present invention provides an auditory prosthesis, or hearing aid, which utilizes the intelligence of a human, typically the user of the hearing aid, to select and control the filter adaption process. This allows for eliminating much of the complexity of the system disclosed in the Graupe et al '721 patent and, furthermore, eliminates unwanted "pumping" effects. The auditory prosthesis of the present invention maintains, however, much if not all of the advantage of the system disclosed in the Graupe et al '721 patent. Moreover, the auditory prosthesis of the present invention is more desirable than the system disclosed in the Graupe et al '721 patent because the hearing aid user enjoys some control over the filtering characteristics of the hearing aid, and because filtering characteristics are changed in direct response to the user's needs and desires as opposed to preprogrammed unalterable criteria set by the hearing aid designs. In particular, the auditory prosthesis of the present invention provides that the user can define the "unwanted" background noise sought to be eliminated. In addition, the alternate embodiment of the invention wherein it continually adapts in a slow adaption mode provides the advantageous characteristics of the system disclosed in the Graupe et al '721 patent to continually adapt to changing environmental background noise while at the same time eliminating the annoying "pumping" noise generated by the system disclosed in the Graupe et al '721 patent. Moreover, the auditory prosthesis of the present invention is simpler in design and consequently less costly than the system disclosed in the Graupe et al '721 patent because it does not require circuitry to detect the presence and absence of speech in the user's environment.

Figure 4:
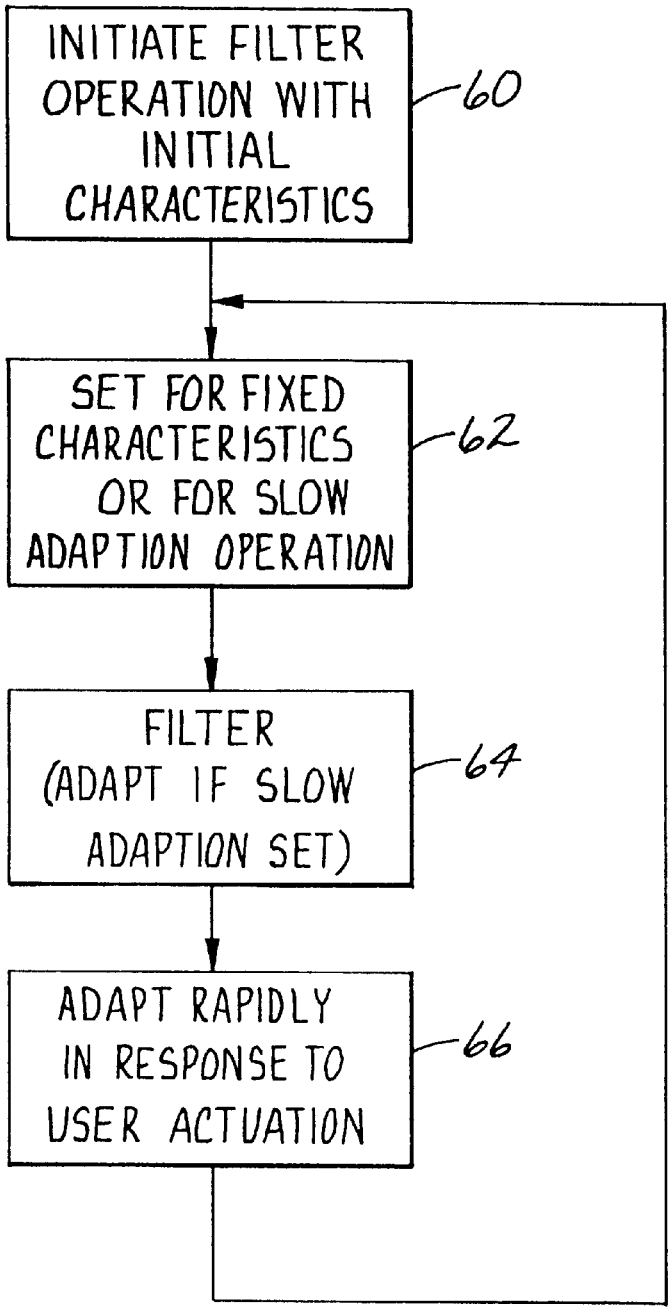
FIG. 4 is a simplified flow chart illustrating a method of filter adaption according to the present invention.

Referring to FIG. 4, the method of the invention is shown in block diagram flow chart form. As generally shown in FIG. 4, the method begins with step 60 in which the filter is placed in use with the user and is initiated to an initial filtering configuration, for instance upon power on of auditory prosthesis 1. Adaptive filter 16 can be set so that the characteristics are fixed or so that the filter slowly adapts on a continuous basis (62). Block 64 represents the operation of the filter to filter, either with fixed characteristics or with slowly changing characteristics if the filter is set to slowly adapt. Adaptive filter 16 continues to operate in this manner unless and until the user (or an automatic activation system) actuates adaptive filter 16 to rapidly adapt, as represented by block 66. As noted above, the user or automatic system preferably actuates rapid adaption when only unwanted background noise is present in the environment, causing adaptive filter 16 to rapidly set its filtering characteristics to filter out the unwanted noise. Once rapid adaption is complete, adaptive filter 16 is set back either to operating with fixed characteristics or to slowly adapt (62), and returns to normal filtering operation (64). If adpative filter 16 is set to slowly adapt while filtering in its normal mode of operation, the adaption is paced such that no abrupt changes in filtering response are discernible by the user, thus avoiding the "pumping" sounds annoying to user's of the auditory prosthesis 1 but yet allowing adaptive filter 16 to gradually adjust to prevailing noise conditions.

While the hearing aid application of adaptive filter 16 has been described with reference to implementation in an auditory prosthesis in which the auditory stimulus is an amplified sound, it shall be understood that other means to provide the sensation of sound in the form of user perceptible stimulus could be substituted for speaker 21. For example, but not by way of limitation, the output of auditory proshtesis 1 could be electrical stimuli to be applied electrodes implanted in the user's ear, or could be in the form of tactile sensations applied to the user's body. Techniques and apparatus for delivering such stimuli are well known in the art and thus will not be discussed herein.

Figure 5:
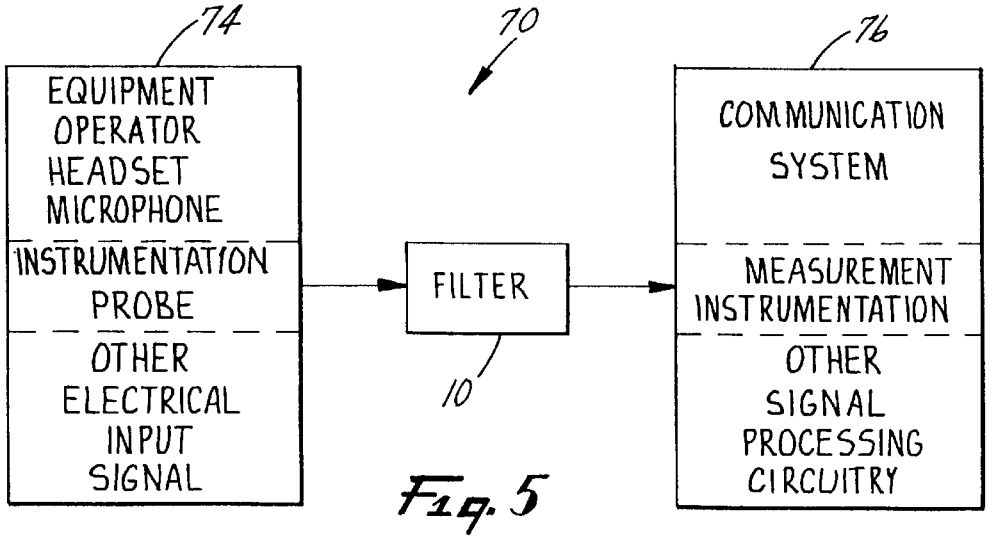
FIG. 5 is a simplified block diagram illustrating alternate applications of the present invention.

The present invention, while particularly useful in its application to the auditory prosthesis arts, finds application more generally in communication systems at large and for non-communication related signal processing as for example used to filter noise in measurement instrumentation applications. Referring to FIG. 5 there is shown the filter of the present invention as used in other applications as generally denoted as a system 70. A source of input signal 74 provides the input signal to adaptive filter 16 which is sought to be filtered to eliminate an unwanted component. Input signal source 74 may be, for instance, the microphone of an equipment operator's headset, for example the headset of a fighter pilot or tank operator. In such cases, the background noise sought to be eliminated is the noise from the equipment being operated, for instance the noise present in the cockpit of a jet or inside a tank, with respect to the examples above-noted. The adaptive filter 16 can be used to filter out the noise from the equipment from the speech component of the microphone input thus enhancing the clarity of the voice on the receiving end of the communication system, which is generally indicated in block 76. Adaptive filter 16 is also useful to filter an input signal in measurement instrumentation applications wherein the signal of interest is obtained, for instance, from an instrumentation probe such as an oscilloscope probe or a thermocouple probe. In these case the noise sought to be eliminated would be unwanted electrical background noise and the filtered input signal would be applied, for instance, to measurement instrumentation amplifiers or other measurement instrumentation signal processing circuits, as also generally indicated by block 76.

The above-noted applications of adaptive filter 16 are not intended to be limiting in any respect but merely illustrative of the broad range of potential signal filtering applications to which adaptive filter 16 can be put. In this regard it is noted that adaptive filter 16 can be applied anywhere in a signal processing stream and is in no way limited to application near the source of input signal. For instance, it could be implemented downstream of other signal processing circuits.

Although the invention has been described above in its preferred form, those of skill in the art will recognize that various changes and modifications may be made thereto without departing from the spirit and scope of the invention as set forth in the following claims.

What is claimed is:

1. An auditory prosthesis adapted to receive environmental sound which contains a selected auditory component and to supply an auditory stimulus which is perceptible to a user, comprising:

a transducer adapted to receive said environmental sound and convert said environmental sound into an electrical input signal containing a selected electrical component corresponding to said selected auditory component in said environmental sound;

an adaptive filter receiving said electrical input signal and providing a filtered signal, said adaptive filter having adaptable filtering characteristics based upon a reference and being operable in response to activation to adapt said filtering characteristics using said electrical input signal as said reference to determine said filtering characteristics required to filter said selected electrical component from said electrical input signal, said adaptive filter continuing to provide said filtered signal while adapting said filtering characteristics in response to said activation;

a receiver receiving said filtered signal and converting said filtered signal to said auditory stimulus; and user-controlled activation means for activating said adaptive filter at a time controlled by said user, whereby said user can initiate adaptation of said filter without changing operating characteristics of said filter other than as a result of said adaptation.

2. An auditory prosthesis as in claim 1 wherein said activation means comprises a manually activated switch electrically connected to said adaptive filter to provide for activation of said adaptive filter by said user.

3. An auditory prosthesis as in claim 1 wherein said adaptive filter terminates from adapting automatically based upon predetermined termination criteria.

4. An auditory prosthesis adapted to receive environmental sound which contains a selected auditory components and adapted to supply an auditory stimulus perceptible to a user, comprising:

a transducer receiving said environmental sound and converting said environmental sound into an electrical input signal, said electrical input signal containing a selected electrical component corresponding to said selected auditory component in said environmental sound;

an adaptive filter receiving said electrical input signal and providing a filtered signal, said adaptive filter having adaptable filtering characteristics based upon a reference and being operable in response to an activation signal, while continuing to provide said filtered signal, to rapidly adapt said filtering characteristics using said electrical input signal as said reference to determine the filtering characteristics required to filter said selected electrical component from said electrical input signal, said adaptive filter being operable, when not rapidly adapting, to slowly adapt said filtering characteristics using said electrical input signal as said reference to determine said filtering characteristics required to filter said selected electrical component from said electrical input signal;

a receiver receiving said filtered signal and converting said filtered signal to said auditory stimulus; and user-controlled activation means for providing said activation signal, whereby said user can initiate rapid adaptation of said filter at a time controlled by said user without changing operating characteristics of said filter other than as a result of said adaptation.

5. An auditory prosthesis as in claim 4 wherein said adaptive filter adapts approximately thirty-two times faster when rapidly adapting than when slowly adapting.

6. An auditory prosthesis as in claim 4, wherein said activation means comprises a manually activated switch electrically connected to said adaptive filter to provide said activation signal.

7. An auditory prosthesis as in claim 4 wherein said adaptive filter continues to rapidly adapt once activated by said user and is responsive to deactivation by said user.

8. An auditory prosthesis as in claim 4 wherein said auditory filter terminates from rapidly adapting automatically based upon a predetermined termination criteria.

9. An auditory prosthesis adapted to receive environmental sound which contains a selected auditory component predominantly at certain times and which contains both said selected auditory component and unselected components at other times, said auditory prosthesis adapted to supply an auditory stimulus perceptible to a user, comprising:

a transducer adapted to receive said environmental sound and convert said environmental sound into an electrical input signal containing a selected electrical component corresponding to said selected auditory component in said environmental sound;

an adaptive filter receiving said electrical input signal and providing a filtered signal, said adaptive filter having adaptable filtering characteristics based upon a reference and being operable in response to activation to adapt said filtering characteristics using said electrical input signal as said reference so that said adaptive filter substantially filters said selected electrical component from said electrical input signal, said adaptive filter then being fixed until subsequent activation, said activation causing said filtering characteristics to adapt while said filter continues to provide said filtered signal;

a receiver receiving said filtered signal and converting said filtered signal to said auditory stimulus; and user-controlled activation means for activating said filter, whereby said user can initiate adaptation of said filter at a time controlled by said user when said environmental sound predominantly contains only said selected auditory component, without changing operating characteristics of said filter other than as a result of said adaptation.

10. An auditory prosthesis adapted to receive environmental sound which contains a selected auditory component predominantly at certain times and which contains both said selected auditory component and unselected components at other times, said auditory prosthesis adapted to supply an auditory stimulus perceptible to a user, comprising:

a transducer receiving said environmental sound and converting said environmental sound into an electrical input signal, said electrical input signal containing a selected electrical component corresponding to said selected auditory component in said environmental sound;

an adaptive filter receiving said electrical input signal and providing a filtered signal, said adaptive filter having adaptable filtering characteristics based upon a reference and being operable in response to activation to rapidly adapt said filtering characteristics using said electrical input signal as said reference so that said adaptive filter substantially filters said selected electrical component from said electrical input signal, said adaptive filter further being operable, when not rapidly adapting, to slowly adapt said filtering characteristics using said electrical input signal as said reference, said activation causing said filtering characteristics to adapt while said filter continues to provide said filtered signal;

a receiver receiving said filtered signal and converting said filtered signal to said auditory stimulus; and user-controlled activation means for activating said filter, whereby said user can initiate rapid adaptation of said filter at a time controlled by said user when said environmental sound predominantly contains only said selected auditory component, without changing operating characteristics of said filter other than as a result of said adaptation.

11. An auditory prosthesis adapted to receive environmental sound which contains a selected auditory component and to supply an auditory stimulus which is perceptible to a user, comprising:

a transducer adapted to receive said environmental sound and convert said environmental sound into an electrical input signal containing a selected electrical component corresponding to said selected auditory component in said environmental sound;

an adaptive filer receiving said electrical input signal and providing a filtered signal, said adaptive filter having adaptable filtering characteristics and being operable in response to activation to adapt said filtering characteristics based upon said electrical input signal, said adaptive filter then being fixed until subsequent activation, said activation causing said filtering characteristics to adapt while said filter continues to provide said filtered signal;

a receiver receiving said filtered signal and converting said filtered signal to said auditory stimulus; and user-controlled activation means for activating said adaptive filter at a time controlled by said user, whereby said user can initiate adaptation of said filter without changing operating characteristics of said filter other than as a result of said adaptation.

12. An auditory prosthesis adapted to receive environmental sound which contains a selected auditory component predominantly at certain times and which contains both said selected auditory component and unselected components at other times, said auditory prosthesis adapted to supply an auditory stimulus perceptible to a user, comprising:

a transducer adapted to receive said environmental sound and convert said environmental sound into an electrical input signal containing a selected electrical component corresponding to said selected auditory component in said environmental sound;

an adaptive filter receiving said electrical input signal and providing a filtered signal, said adaptive filter having adaptable filtering characteristics and being operable in response to activation, when said environmental sound predominantly contains only said selected auditory component, to adapt said filtering characteristics based upon said electric input signal, said adaptive filter then being fixed until subsequent activation, said activation causing said filtering characteristics to adapt while said filter continues to provide said filtered signal;

a receiver receiving said filtered signal and converting said filtered signal to said auditory stimulus; and user-controlled activation means for activating said adaptive filter at a time controlled by said user, whereby said user can initiate adaptation of said filter without changing operating characteristics of said filter other than as a result of said adaptation.

13. An auditory prosthesis adapted to receive environmental sound which contains a selected auditory component and adapted to supply an auditory stimulus perceptible to a user, comprising:

a transducer receiving said environmental sound and converting said environmental sound into an electrical input signal containing a selected electrical component corresponding to said selected auditory component in said environmental sound;

an adaptive filter receiving said electrical input signal and providing a filtered signal, said adaptive filter having adaptable filtering characteristics and being operable in response to activation, while continuing to provide said filtered signal, to rapidly adapt said filtering characteristics based upon said electrical input signal, said filter being operable, when not rapidly adapting, to slowly adapt said filtering characteristics using said electrical input signal as a reference;

a receiver receiving said filtered signal and converting said filtered signal to said auditory stimulus; and user-controlled activation means for activating said filter, whereby said user can initiate rapid adaptation of said filter at a time controlled by said user without changing operating characteristics of said filter other than as a result of said adaptation.

14. An auditory prosthesis adapted to receive environmental sound which contains a selected auditory components predominantly at certain times and which contains both said selected auditory component and unselected components at other times, said auditory prosthesis adapted to supply an auditory stimulus perceptible to a user, comprising:

a transducer receiving said environmental sound and converting said environmental sound into an electrical input signal containing a selected electrical component corresponding to said selected auditory component in said environmental sound;

an adaptive filter receiving said electrical input signal and providing a filtered signal, said adaptive filter having adaptable filtering characteristics and being operable in response to activation, when said environmental sound predominantly contains only said selected auditory component, to rapidly adapt said filtering characteristics based upon said electrical input signal, said adaptive filter further being operable, when not rapidly adapting, to slowly adapt said filtering characteristics based upon said electrical input signal, said activation causing said filtering characteristics to adapt while said filter continues to provide said filtered signal;

a receiver receiving said filtered signal and converting said filtered signal to said auditory stimulus; and user-controlled activation means for activating said filter, whereby said user can initiate rapid adaptation of said filter at a time controlled by said user without changing operating characteristics of said filter other than as a result of said adaptation.

15. A method of controlling an auditory prosthesis which is adapted to receive environmental sound which contains a selected auditory component and supply an auditory stimulus perceptible to a user, said auditory prosthesis having a transducer receiving said environmental sound and converting said environmental sound into an electrical input signal containing a selected electrical component corresponding to said selected auditory component in said environmental sound, an adaptive filter having adaptable filtering characteristics based upon a reference and being operable to filter said electrical input signal to provide a filtered signal, said filter being operable in response to activation to adapt said filtering characteristics based upon said electric input signal while continuing to provide said filtered signal, said adaptive filter then being fixed until subsequent activation, and a receiver receiving said filtered signal and converting said filtered signal to said auditory stimulus, comprising the steps of:

placing said auditory prosthesis in use in conjunction with said user with said environmental sound containing said selected auditory component; and activating said adaptive filter in response to operation by said user of user-operable activation means to adapt said filtering characteristics using said electrical input signal as said reference to determine the filtering characteristics required to filter said selected electrical component from said electrical input signal, whereby said user initiates adaptation of said filter at a time controlled by said user without changing operating characteristics of said filter other than as a result of said adaptation.

* * * * *